United States Patent [19]

Minejima et al.

[11] 4,401,382

[45] Aug. 30, 1983

[54] IMAGE TRANSFER TYPE COPYING MACHINE

[75] Inventors: Teruo Minejima; Isao Sakurai, both of Hachioji, Japan

[73] Assignee: Konishiroku Photo Industry Co., Ltd., Tokyo, Japan

[21] Appl. No.: 298,952

[22] Filed: Sep. 3, 1981

[30] Foreign Application Priority Data

Sep. 18, 1980 [JP] Japan ..... 55-130227

[51] Int. Cl.[3] ..... G03G 15/00

[52] U.S. Cl. ..... 355/3 SH; 271/DIG. 2; 271/313

[58] Field of Search ..... 355/3 R, 3 TR, 3 SH; 271/DIG. 2, 307, 308, 311, 313

[56] References Cited

U.S. PATENT DOCUMENTS

| | | | |
|---|---|---|---|
| 4,073,585 | 2/1978 | Kobayashi et al. | 271/DIG. 2 |
| 4,092,021 | 5/1978 | Fletcher | 271/DIG. 2 |
| 4,244,648 | 1/1981 | Schultes et al. | 355/3 SH |
| 4,252,310 | 2/1981 | Kono et al. | 271/DIG. 2 |

*Primary Examiner*—R. L. Moses

*Attorney, Agent, or Firm*—Jordan B. Bierman; Linda Bierman

[57] ABSTRACT

In the absence of normal sheet separation by a main separating device, a second back-up type sheet separating device is provided downstream from the main separating device for removing copy sheets from the photoconductive drum surface of an electrostatic copier. The secondary sheet separating device consists of a separating blade which is maintained in a predetermined spaced relation to the photoconductive drum surface by virtue of its mounting on a pivotally supported roller.

6 Claims, 4 Drawing Figures

IMAGE TRANSFER TYPE COPYING MACHINE

BACKGROUND OF THE INVENTION

1. Field of the Invention

The present invention relates to a copying machine having a separation mechanism, by which a toner image formed on an image retaining member is to be transferred onto a transfer paper, and the transfer paper carrying said toner image is effectively separated.

2. Description of the Prior Art

Conventionally, in an image transfer type of the electrophotographic copying machines, the electrostatic recording machines, or the like, a toner image formed on an image retaining member is transferred onto a transfer paper, and the transfer paper carrying said toner image is separated from said image retaining member and fixed, and thus ejected from the machine.

Wherein, for separating a transfer paper, the following methods have been adopted; the method that separation of a transfer paper is made through the use of a separation electrode so as to electrostatically neutralize the electric charge having been held on the image transferred paper; the method that, by using of a movable separation claw, a transfer paper is run against the front end of said claw with an image retaining member transiently, and thus separated; the method that a transfer paper is separated by making use of said separation electrode and separation claw jointly; or the like. However, the separating methods having so far been adopted cannot always achieve any complete separation, and in the case that a separation failure was to occur with those methods, said failure is detected by a sensor and the mechanical operations are stopped in action by the signal given from said sensor, and a copying is interrupted in operation once, and said jammed paper is removed in the meanwhile, and then the copying operations are resumed work.

In this connection, whenever a separation failure occurs, the troublesome labor for removing said jammed paper is required, and therefore, not only the time is wasted, but also it is attended by many evils such as the damage on a photosensitive substance on the image retaining member, a separation claw and a separation electrode, at the time when removing said jammed paper.

The present inventors have studied to eliminate completely the abovementioned labor for removing a jammed paper. Supposing the aforesaid separation method is correctly adopted, then no separation failure will occur at all. However, it is at variance with the reality. Though there are some feasible separation methods, but the reason why such methods cannot be adopted as a separation method to be applicable to a copying machine, is that said methods cannot satisfy the conditions that a transfer paper can completely be separated from the image retaining member, and that a toner image on a transfer paper (if touched said toner image remaining unfixed, the toners will move and disturb the image) cannot be damaged when the separation is made.

SUMMARY OF THE INVENTION

The present invention has been made with the object to provide a copying machine, wherein a human labor is eliminated from the work to remove a separation failure, and no damage is caused on the various image forming members which were arranged on both image retaining member and the outside circumference of said image retaining member, and the operational efficiency thereof is improved. The present invention can be achieved by said copying machine, wherein a transfer paper is separated by first separating means from an image retaining member after a toner image has been transferred from said image retaining member to the transfer paper, and thus said transfer paper is ejected from the machine, and, wherein second separating means is provided at the rear of the position of separation to ensure the separating a transfer paper, and in the case that a separation failure was to cause with said first separating means, the transfer paper which has not been separated by the first separating means is separated by the second separating means and thus ejected from the machine, with a transfer paper transporting means and said image retaining member keeping in operation without stopping.

DETAILED DESCRIPTION OF THE PREFERRED EMBODIMENTS

Figure 1:
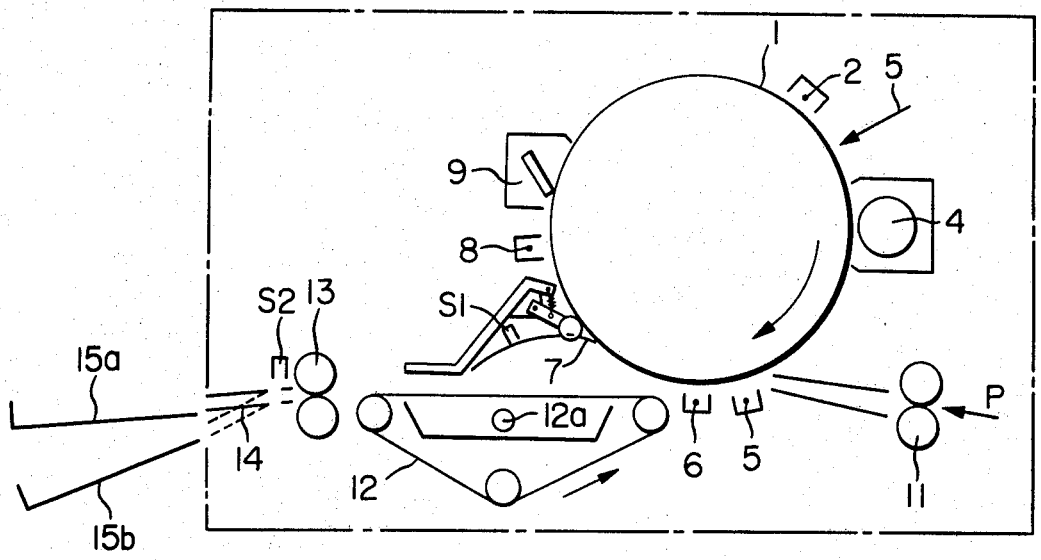
FIG. 1 is a general cross-sectional view of the example of the present invention.

Referring to the drawings, the present invention is now concretely explained as follows.

FIG. 1 is a general cross-sectional view of the example in the copying machine of the present invention. Around the photosensitive substance drum 1 having materials such as photoconductive selenium or zinc oxide on its circumferential surface, there are arranged a corona charger 2, an exposure portion 3, a toner developing unit 4, a transfer electrode 5, a separation electrode (first separating means) 6, a second separating device 7, a charge eliminating electrode 8 and a cleaning unit 9, all adjoining each other in the direction of rotation thereof (clockwise direction in the drawing).

Meanwhile, the transfer paper P is conveyed from the right to the left in the drawing. The numeral 11 on the right is a registration roller, 12 is a conveyance belt and **12*a* is a suction. The numeral 13 is a fixing unit, 14 is a conveyance switching portion and 15** is a paper ejecting tray.

The operation will now be explained. The circumferential surface of the photosensitive substance drum 1 is first charged when it passes the portion of the corona charger 2 and an electrostatic latent image is formed at the exposure portion 3. Then, after passing the toner developing unit 4, the electrostatic latent image is developed and is turned to the toner image. Meanwhile, the transfer paper P is fed by the registration roller 11 synchronously with the motion of the photosensitive substance drum 1 and then contacts at the portion of the transfer electrode 5, thus the toner image on the surface of the photosensitive substance drum 1 is transferred onto the transfer paper. Then the transfer paper P is separated from the surface of the photosensitive substance drum 1 by the separation electrode 6 and contacts closely the conveyance belt 12 being absorbed by the suction **12*a* and moves to the left on the drawing with the rotation of the conveyance belt 12 and then is ejected to the regular paper ejecting tray 15*a* after passing the fixing unit 13**.

The separation electrode 6 is an excellent separation means that separation is made touching the transfer paper but it is not a perfect separation means. The operation to be taken when a separation failure occurs will be explained next.

Figure 2:
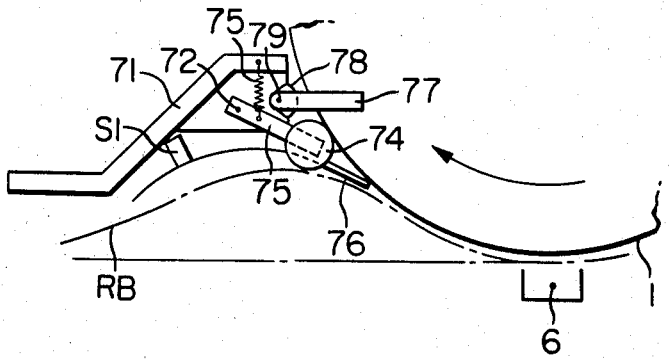
FIG. 2 is a side view of the second separating means.

FIG. 2 shows the detail of the second separating device 7 wherein 71 is a guide plate that is fixed together with the main frame of the copying machine. The supporting shaft 72 is located on the guide plate 71 and there is a lever 73 whose rotating center is the supporting shaft 72. On the lever 73, there is a rotating roller 74 whose rotating center is on the lever 73 and between the lever 73 and the guide plate 71, the spring 75 is tensilely suspended and therefore the rotating roller 74 touches the photosensitive substance drum 1 with pressure and rotates being driven by the rotation of the photosensitive substance drum 1.

The numeral 76 is a separating member which is made of a conductive metal thin blade or mylar base or the like and is fixed to the lever 73. The numeral 77 is a lever for moving the separating device and it has a cam surface 78 and is rotatably supported around the supporting shaft 70 and it is provided in order to keep the lever 73 off the surface of the holding body so that the tip of aforesaid lever does not hurt the image retaining member when the separating device is attached to or detached from the machine body.

With aforesaid structure, it is easy to keep stationary the clearance between the surface of the photosensitive substance drum and the extremity of the separating member 76 at 0.01–0.06 mm, if the tool is used. When the extremity of the separating member 76 is kept, in this way, at the position where it does not contact the photosensitive substance drum 1 but it is very close thereto, the paper having a separation failure at the first separating means 6 is surely separated by the separating member 76 since the thickness of the paper used is usually larger than 0.074 mm and is conveyed along the path that is shown with RB. The separation failure paper can not be used as a copy because the toner image thereon contacts the second separating device 7 and said toner image is disturbed.

Now, the sensor S1 that detects the separation failure paper that is conveyed along the conveyance path RB for said paper and the sensor S2 that is provided at the paper ejecting portion and checks the paper eject, conduct following operations.

(1) A conveyance switching portion 14 is controlled so that a separation failure paper is ejected to the paper ejecting tray **15*b* arranged separately for the waste paper without being ejected to the paper ejecting tray 15*a*** to which a regular copy is ejected.

(2) When counting the number of copies, the separation failure paper is not counted.

Figure 3:
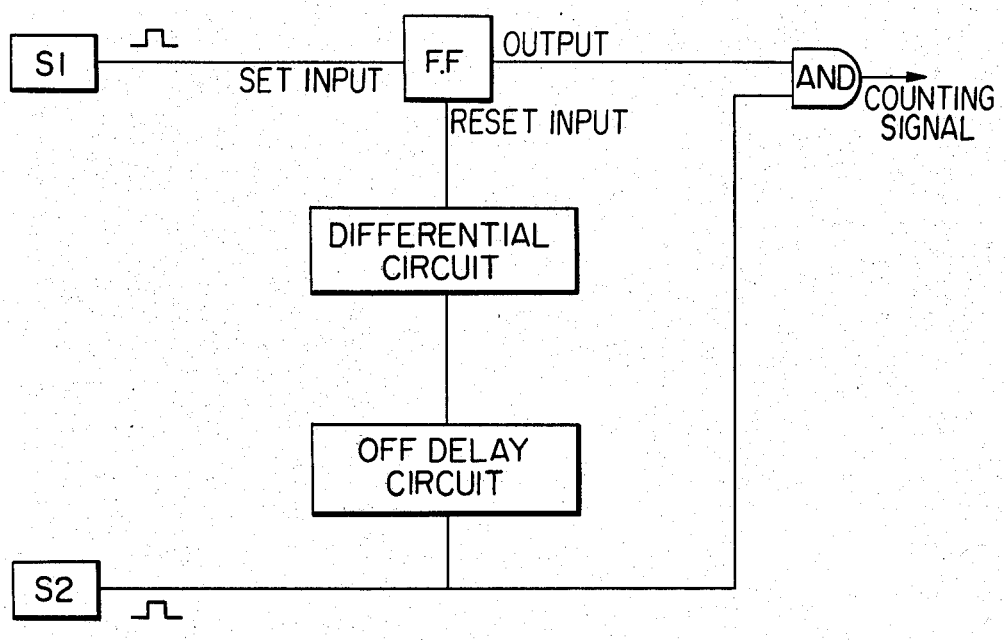
FIG. 3 is a circuit diagram newly added to the example of the present invention and the sequence thereof is shown in FIG. 4.
Figure 4:
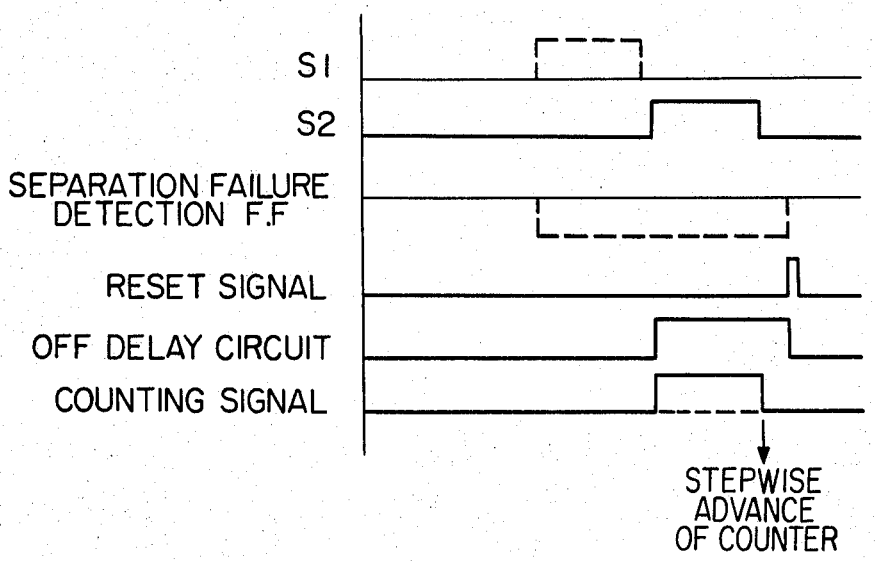

FIG. 3 is a circuit diagram for the aforesaid operation and FIG. 4 shows a sequence wherein dotted lines show the period of separation failure.

On the circuit diagram of FIG. 3, the sensor S1 to detect the separation failure paper is connected to the set input terminal of the separation failure detection FF (flip-flop), the output terminal of the separation failure detection FF is connected to the input terminal on the one side of the AND circuit and the sensor S2 for paper exit detection is connected to the input terminal on the other side of the AND circuit. The output of the AND circuit is connected as a counting signal of the copy counter (unillustrated).

Further, the sensor S2 is also connected to the off delay circuit and the output of the delay circuit is connected to the differential circuit and furthermore, the output of the differential circuit is connected to the reset terminal of the separation failure detection FF.

In the case of normal operation, the sensor S1 for the separation failure detection does not detect the transfer paper and therefore the separation failure detection FF is in the reset state and 1 level signal is inputted to the input terminal on the one side of the AND circuit. When the paper ejecting sensor S2 detects the transfer paper, 1 lever signal is inputted to the input terminal on the other side of the AND circuit causing the output of the AND circuit to be 1 level. After the completion of the ejection of the transfer paper, a 0 level signal is inputted to the AND circuit from the sensor S2 and therefore, the output of the AND circuit changes from 1 level to 0 level causing the copy counter fixed to the copying machine to advance stepwise.

In the case a separation failure occurs, since that sensor S1 detects the transfer paper that is separated by the second separating means, the separation failure detecting FF is set and the output of FF becomes 0 level and is inputted to the input terminal on the one side of the AND circuit. Next, when the sensor S2 detects the transfer paper to be ejected, 1 level signal is inputted to the input terminal on the other side of the AND circuit and the output of the AND circuit is kept at 0 level since a 0 level signal is inputted to the input terminal on the one side of the AND circuit. Therefore, the AND circuit does not generate the counting signal for the copy counter even if it receives the signal of the sensor S2, and thus, the transfer paper separated by the second separating means is not counted by the copy counter and only the transfer paper separated normally is counted.

The off delay circuit generates the output signal when it receives the signal of the sensor S2 and it is composed of a general circuit wherein a resistance, a capacitor, a diode and a comparator are used so that generating of the output is continued for a short period of time even after the completion of the signal of the sensor S2 and its output is inputted to the differential circuit, and the differential circuit is composed of a general circuit wherein a resistance and a capacitor are used so that the output signal is generated as a reset signal of the separation failure detection F.F. when the signal is stopped after the output signal of the off delay circuit is inputted, and therefore, the reset signal is inputted to the separation failure detection F.F. with a few delay after the completion of the detection made by the sensor S2 for the transfer paper. Therefore, when the separation failure detection F. F. is in the reset state, no change is generated on the output state but when it is in the set state, the circuit is reset and its output is changed from 0 level to 1 level and the circuit returns to its normal operation.

Incidentally, the foregoing is for the copy counting. Regarding the operation of the conveyance switching portion 14, the separation failure paper is ejected to the paper ejecting tray **15*b*** for the waste paper if the device is made so that the switching is made with the use of the solenoid or the like when the separation failure detection F.F. is set and restoration thereof is made by the reset of the separation failure detection F.F.

The present invention has eliminated the separation failure that is fatal on the copying machine and the manual removing work needed when the separation failure occurs. Conventional. waste of time and contamination on hands caused by the action to take out the transfer paper that is not fixed have been solved. Furthermore, it has eliminated the damage on the photosensitive substance, separation claws and separation electrode and others caused by the forcible taking out of the transfer paper that is made when removing the separation failure paper.

The second separating means of the present invention is quite different from the separating means that has conventionally been used for the copying machine and it has a purpose of sure separation disregarding the holding of the toner image and the copying machine equipped with such second separating means has many effects as explained in the example.

What is claimed is:

1. In an improved image transfer type copying machine including an image retaining member for receiving a toner image of an original to be copied and into contact with which a sheet for bearing a copy of the original is placed to transfer the toner image to the sheet, and primary means for normally separating the sheet from the image retaining member, the improvement comprising:

secondary means located downstream of said primary means along the image retaining member for separating a sheet from the member in the absence of normal separation of the sheet by said primary means, said secondary means comprising a freewheeling roller, means pivotally supporting said roller so that the roller rides on and along the image retaining surface of said member, and a separating blade mounted on said roller supporting means to maintain said blade in constant and predeterminately spaced relation to the member surface so that a sheet may be separated from the member by said blade without contact between the member surface and the blade.

2. In an improved image transfer type copying machine in accordance with claim 1, said primary separating means comprising a charge separation electrode.

3. In an improved image transfer type copying machine according to claim 1, said predeterminately spaced relation being a distance of between 0.01 and 0.06 mm between the member surface and said blade.

4. In an improved image transfer type copying machine in accordance with claim 1, the improvement further comprising means for detecting a sheet that has been separated from the image retaining member said secondary means, and a waste tray for receiving sheets separated by said secondary means.

5. In an improved image transfer type copying machine in accordance with claim 1, said roller supporting means comprising a pivotally disposed lever upon which said roller and said blade are mounted, and biasing means connected to said lever to urge said roller into continuous contact with the image retaining surface of said member.

6. In an improved image transfer type copying machine in accordance with claim 1, said secondary means further comprising lever and cam means connected to said supporting means for preventing contact between said supporting means and the image retaining member during installation of said secondary supporting means.

* * * * *